US011631507B2

(12) United States Patent
Huang et al.

(10) Patent No.: US 11,631,507 B2
(45) Date of Patent: Apr. 18, 2023

(54) COAXIAL CABLE, COAXIAL CABLE PRODUCING METHOD, AND CABLE ASSEMBLY

(71) Applicant: Hitachi Metals, Ltd., Tokyo (JP)

(72) Inventors: Detian Huang, Tokyo (JP); Takanobu Watanabe, Tokyo (JP); Hideki Nonen, Tokyo (JP); Masashi Arai, Tokyo (JP); Hiromitsu Kuroda, Tokyo (JP); Ryohei Okada, Tokyo (JP); Tamotsu Sakurai, Tokyo (JP)

(73) Assignee: PROTERIAL, LTD., Tokyo (JP)

( * ) Notice: Subject to any disclaimer, the term of this patent is extended or adjusted under 35 U.S.C. 154(b) by 57 days.

(21) Appl. No.: 17/116,664

(22) Filed: Dec. 9, 2020

(65) Prior Publication Data

US 2021/0398713 A1 Dec. 23, 2021

(30) Foreign Application Priority Data

Jun. 23, 2020 (JP) ..... JP2020-107523

(51) Int. Cl.

| | |
|---|---|
| ***H01B 11/10*** | (2006.01) |
| ***H01B 11/18*** | (2006.01) |
| ***H01B 13/14*** | (2006.01) |
| ***H01B 13/016*** | (2006.01) |
| ***H01B 13/06*** | (2006.01) |
| ***H01B 13/00*** | (2006.01) |

(52) U.S. Cl.

CPC ..... *H01B 11/1843* (2013.01); *H01B 11/1821* (2013.01); *H01B 13/0016* (2013.01); *H01B 13/0167* (2013.01); *H01B 13/067* (2013.01); *H01B 13/145* (2013.01)

(58) Field of Classification Search

CPC ..... H01B 7/221; H01B 9/025; H01B 11/1041

See application file for complete search history.

(56) References Cited

U.S. PATENT DOCUMENTS 2,181,475 A * 11/1939 Bourdon ..... B60C 15/04 57/232
4,120,145 A * 10/1978 Chiappetta ..... D07B 1/144 57/220

(Continued)

FOREIGN PATENT DOCUMENTS

JP 2000-285747 A 10/2000
JP 2007-023305 * 2/2007

*Primary Examiner* — Chau N Nguyen

(74) *Attorney, Agent, or Firm* — McGinn I.P. Law Group, PLLC.

(57) ABSTRACT

A coaxial cable includes a conductor, an electrically insulating member provided over a periphery of the conductor, a shielding layer composed of served shields formed by helically wrapping a plurality of metal wires around the electrically insulating member, and a sheath provided around the shielding layer. The electrically insulating member includes indentations on portions of its surface to be brought into contact with and mated to the metal wires respectively. The shielding layer includes portions in respective circumferential directions of the plurality of metal wires being brought into contact with the electrically insulating member are mated to the indentations, respectively, on the electrically insulating member, and adjacent ones of the metal wires in a circumferential direction of the shielding layer are in surface contact with each other.

15 Claims, 5 Drawing Sheets

(56) References Cited

U.S. PATENT DOCUMENTS

| | | | | |
|---|---|---|---|---|
| 7,793,409 | B2 * | 9/2010 | Varkey | H01B 13/24<br>174/102 R |
| 2015/0348677 | A1 * | 12/2015 | Pourladian | H01B 7/046<br>174/107 |

* cited by examiner

COAXIAL CABLE, COAXIAL CABLE PRODUCING METHOD, AND CABLE ASSEMBLY

CROSS-REFERENCE TO RELATED APPLICATION

The present application is based on Japanese patent application No. 2020-107523 filed on Jun. 23, 2020, the entire contents of which are incorporated herein by reference.

BACKGROUND OF THE INVENTION

1. Field of the Invention

The present invention relates to a coaxial cable, a method for producing a coaxial cable, and a cable assembly.

2. Description of the Related Art

A coaxial cable has been used as a cable for a high frequency signal transmission, which is used in an internal wiring for an image recording device used in an automatic operation or the like, or an electronic device such as a smartphone, a tablet terminal or the like, or which is used in a wiring for a machine tool such as an industrial robot or the like.

As a conventional coaxial cable, there is known a coaxial cable including a shielding layer formed by helically wrapping a tape member such as a copper tape composed of a copper foil provided on a resin layer or the like around a periphery of an electrically insulating member. See, e.g., JP2000-285747A.

[Patent Document 1] JP2000-285747A

SUMMARY OF THE INVENTION

However, in the above described conventional coaxial cable, there is a problem with a phenomenon called sucking out occurring which refers to a rapid attenuation caused in a predetermined frequency band (e.g., a band of several GHz such as 1.25 GHz or the like).

On the other hand, for example, by configuring the shielding layer in such a manner that an outer surface of the electrically insulating member is subjected to a plating, it is possible to suppress the occurrence of the sucking out. However, when the coaxial cable has been repeatedly bent, a crack formation in a shielding layer made of the plating has occurred or a peeling off of that shielding layer made of the plating from the outer surface of the electrically insulating member has occurred. The occurrence of the crack formation in its shielding layer made of the plating or the peeling off of that shielding layer made of the plating from the outer surface of the electrically insulating member has led to a degradation in the shielding effect. That is, the shielding effect of the shielding layer on the noise caused in the coaxial cable has been degraded.

In light of the foregoing, it is an object of the present invention to provide a coaxial cable, a method for producing a coaxial cable, and a cable assembly, which are resistant to the occurrence of a degradation in the shielding effect, and resistant to the occurrence of a rapid attenuation in a predetermined frequency band.

For the purpose of solving the above described problems, according to one aspect of the invention, a coaxial cable, comprises:

a conductor;

an electrically insulating member provided over a periphery of the conductor; a shielding layer composed of served shields including a plurality of metal wires helically wrapped around a periphery of the electrically insulating member to be provided over a periphery of the electrically insulating member; and a sheath provided over a periphery of the shielding layer, wherein the electrically insulating member includes indentations on portions of a surface of the electrically insulating member to be brought into contact with the plurality of metal wires respectively, wherein the indentations on the electrically insulating member are mated to the plurality of metal wires respectively, wherein the shielding layer is configured in such a manner that portions in respective circumferential directions of the plurality of metal wires being brought into contact with the electrically insulating member are mated to the indentations, respectively, on the electrically insulating member, and adjacent ones of the plurality of metal wires in a circumferential direction of the shielding layer are brought into surface contact with each other.

Further, for the purpose of solving the above described problems, according to another aspect of the invention, a method for producing a coaxial cable configured to include a conductor, an electrically insulating member provided over a periphery of the conductor, a shielding layer composed of served shields including a plurality of metal wires helically wrapped around a periphery of the electrically insulating member to be provided over the periphery of the electrically insulating member, and a sheath provided over a periphery of the shielding layer, comprises:

providing the electrically insulating member over the periphery of the conductor by extrusion molding to form a core section;

helically wrapping the plurality of metal wires around a periphery of the core section;

heating the core section wrapped with the plurality of metal wires therearound to soften the electrically insulating member of the core section;

passing the plurality of heated metal wires and the heated core section through a die to compress the heated metal wires toward the core section, thereby forming indentations to be mated to the plurality of metal wires respectively, on portions of a surface of the softened electrically insulating member of the core section to be brought into contact with the plurality of metal wires respectively, mating portions in respective circumferential directions of the plurality of metal wires to be brought into contact with the electrically insulating member to the indentations, respectively, on the electrically insulating member, and bringing adjacent ones of the plurality of metal wires in a circumferential direction of the shielding layer into surface contact with each other, to thereby form the shielding layer;

heating the shielding layer, to thereby relieve a strain in the plurality of metal wires resulting from the compressing; and providing the sheath by extrusion molding over the periphery of the shielding layer.

Furthermore, for the purpose of solving the above described problems, according to still another aspect of the invention, a cable assembly, comprises:

the coaxial cable according to the one aspect of the invention; and a terminal member integrally provided to at least one end portion of the coaxial cable.

POINTS OF THE INVENTION

According to the present invention, it is possible to provide the coaxial cable, the method for producing the coaxial cable, and the cable assembly, which are resistant to the occurrence of a degradation in the shielding effect, and resistant to the occurrence of a rapid attenuation in a predetermined frequency band.

DETAILED DESCRIPTION OF THE PREFERRED EMBODIMENTS

Embodiment

An embodiment of the present invention will be described below with reference to the accompanying drawings.

Figure 1A:
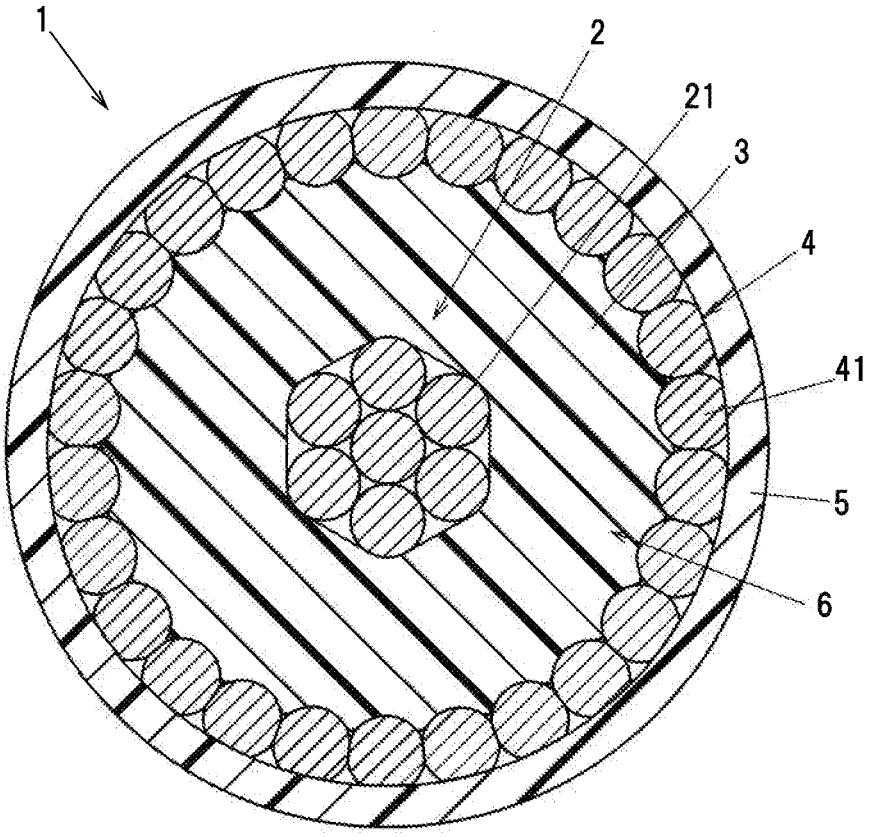
FIG. 1A is a cross-sectional view showing a cross section perpendicular to a longitudinal direction showing a coaxial cable according to one embodiment of the present invention.
Figure 1B:
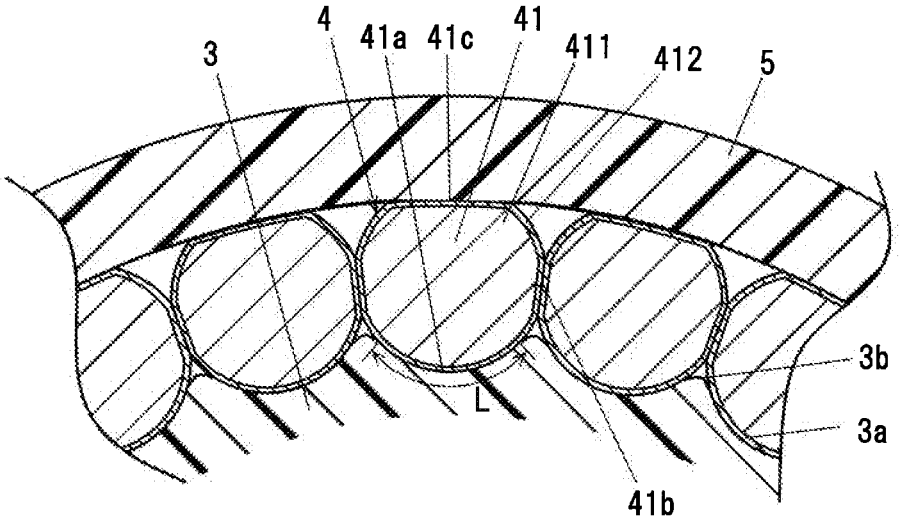
FIG. 1B is an enlarged view of an essential portion of the coaxial cable shown in FIG. 1A.

FIG. 1A is a cross-sectional view showing a cross section perpendicular to a longitudinal direction showing a coaxial cable 1 according to the present embodiment, and FIG. 1B is an enlarged view of an essential portion of the coaxial cable 1 shown in FIG. 1A.

As shown in FIGS. 1A and 1B, the coaxial cable 1 includes a conductor 2, an electrically insulating member 3, which is provided to coat a periphery of the conductor 2, and a shielding layer 4, which is provided to coat a periphery of the electrically insulating member 3, and a sheath 5, which is provided to coat a periphery of the shielding layer 4.

The conductor 2 is made of a stranded wire conductor, which is formed by stranding a plurality of metal wires 21 together. The configuration of the conductor 2 is not limited thereto, but the conductor 2 can also be configured to use a compressed stranded wire conductor, which is produced by stranding the plurality of metal wires 21 together, and subsequently subjecting the stranded metal wires 21 to a compression working in such a manner that the cross-sectional shape of the stranded metal wires 21, which is perpendicular to the longitudinal direction of the coaxial cable 1, becomes a circular shape. The use of the compressed stranded wire conductor as the conductor 2 allows the electrical conductivity of the conductor 2 to be improved, the good transmission property of the conductor 2 to be obtained, and the high bendability of the conductor 2 to be maintained. Further, the metal wire 21 may be composed of a copper alloy wire including a tin (Sn), a silver (Ag), an indium (In), a titanium (Ti), a magnesium (Mg), an iron (Fe) or the like, from the point of view of enhancing the electrical conductivity and the mechanical strength of the plurality of metal wires 21.

The electrically insulating member 3 is made of, e.g., a PFA (perfluoroalkoxy alkane), or a FEP (fluorinated ethylene tetrafluoride/propylene hexafluoride copolymer) fluoropolymer resin, a polyethylene, a polypropylene or the like. The electrically insulating member 3 may be made of a foamed resin, or a crosslinked resin in order to enhance the heat resistance of the electrically insulating member 3. Further, the electrically insulating member 3 may be configured to have a multi-layer structure. For example, the electrically insulating member 3 can also be configured to have a three-layer structure composed of a first non-foamed layer made of a non-foamed polyethylene, which is provided over a periphery of the conductor 2, a foamed layer made of a foamed polyethylene, which is provided over a periphery of the first non-foamed layer, and a second non-foamed layer made of a non-foamed polyethylene, which is provided over a periphery of the foamed layer. In the present embodiment, the electrically insulating member 3 made of the PFA is formed over the periphery of the conductor 2 by tube extrusion. By forming the electrically insulating member 3 over the periphery of the conductor 2 by the tube extrusion, the electrically insulating member 3 is easily peeled off from the conductor 2 during termination working, and the termination workability is therefore enhanced. Hereinafter, the conductor 2 and the electrically insulating member 3 will collectively be referred to as a core section 6.

The shielding layer 4 is composed of served shields (lateral winding shields) formed by a plurality of metal wires (metal strands) 41 being helically wrapped around a periphery of the electrically insulating member 3. In the coaxial cable 1 according to the present embodiment, the shielding layer 4 is configured in such a manner that respective one parts in the circumferential directions of the plurality of metal wires 41 are embedded in the electrically insulating member 3. That is, in the present embodiment, the electrically insulating member 3 includes indentations 3*a* on a surface contacting with the plurality of metal wires 41, and the indentations 3*a* are configured to be mated to the plurality of metal wires 41, respectively. In the shielding layer 4, each of the plurality of metal wires 41 includes a portion contacting with the electrically insulating member 3 in its circumferential direction, which is configured to be mated to the indentation 3*a* on the electrically insulating member 3.

As shown in FIG. 1B, respective inner portions of the plurality of metal wires 41 in the radial direction of the coaxial cable 1 are mated to the respective indentations 3*a* on the electrically insulating member 3 and are in close contact with the electrically insulating member 3 (respective inner peripheral surfaces of the indentations 3*a* on the electrically insulating member 3). Hereinafter, a portion of the outer peripheral surface of each metal wire 41 of the shielding layer 4, which is mated with the indentation 3*a* on the electrically insulating member 3 and is in close contact with the electrically insulating member 3, will be referred to as a mated portion 41*a*. The outer peripheral surface of the electrically insulating member 3 is formed with recesses and protrusions conforming to the shapes of the plurality of metal wires 41. The respective recessed indentations 3*a* configured to receive respective one parts of the plurality of metal wires 41 (be brought contiguous to the respective mated portions 41*a*) and the protruded portions 3*b* located between adjacent ones of the plurality of metal wires 41 are formed alternately in the circumferential direction of the shielding layer 4.

Further, in the present embodiment, the shielding layer 4 is configured in such a manner that the adjacent ones of the plurality of metal wires 41 in the circumferential direction of the shielding layer 4 are brought into surface contact with each other. In the portions of the plurality of metal wires 41 at which the adjacent ones of the plurality of metal wires 41 in the circumferential direction of the shielding layer 4 are brought into surface contact with each other, the portions of the plurality of metal wires 41 are each deformed into a substantially flat shape, and the portions of the plurality of metal wires 41 are in contact with each other with no gap formation therebetween. Hereinafter, the substantially flat shaped portions of the plurality of metal wires 41 at which the plurality of metal wires 41 are in contact with each other will be referred to as wire contact portions 41*b*.

For example, if the served shields are merely configured in such a manner that the plurality of metal wires 41 are helically wrapped around the periphery of the electrically insulating member 3, when the coaxial cable 1 is bent, a gap formation occurs between the plurality of metal wires 41, leading to a degradation in the noise property. Further, the influence of the gap formation caused between the plurality of metal wires 41 leads to a phenomenon called sucking out which is a rapid attenuation caused in a predetermined frequency band (e.g., a band of 10 GHz or the like). As in the present embodiment, in the shielding layer 4, by the respective one parts of the plurality of metal wires 41 being embedded into the indentations 3*a*, respectively, on the electrically insulating member 3, and the adjacent ones of the plurality of metal wires 41 in the circumferential direction of the shielding layer 4 being brought into surface contact with each other, when the coaxial cable 1 is bent, the plurality of metal wires 41 follow the bending movement of the electrically insulating member 3, and therefore the coaxial cable 1 becomes resistant to the occurrence of the gap formation between the plurality of metal wires 41. Further, the plurality of metal wires 41 mated to the indentations 3*a*, respectively, on the electrically insulating member 3, when the electrically insulating member 3 is bent, are moved in the longitudinal direction of the coaxial cable 1 in such a manner as to follow the indentations 3*a*, respectively, on the electrically insulating member 3. As a result, it is possible to enhance the noise property of the coaxial cable 1 even when the coaxial cable 1 is wired by bending, and further it is possible to suppress the occurrence of the sucking out in the band of up to 26 GHz.

Further, since the plurality of metal wires 41 are embedded in the electrically insulating member 3, during the termination working, when the sheath 5 is removed from a terminal portion of the coaxial cable 1 to expose a portion of the shielding layer 4, the plurality of metal wires 41 together constituting the shielding layer 4 become resistant to being unlaid, and the termination working of the coaxial cable 1 can therefore be facilitated. Furthermore, since the plurality of metal wires 41 are brought into close contact with the electrically insulating member 3, the distance between the conductor 2 and the shielding layer 4 can be kept constant in the longitudinal direction of the coaxial cable 1, and the impedance of the coaxial cable 1 can also stably be kept constant in the longitudinal direction of the coaxial cable 1.

In order to, when bending the coaxial cable 1, allow the plurality of metal wires 41 to be moved in the longitudinal direction of the coaxial cable 1 in such a manner as to follow the indentations 3*a*, respectively, on the electrically insulating member 3, and thereby easily follow the movement of the electrically insulating member 3, it is desirable that, at a cross section perpendicular to the longitudinal direction of the coaxial cable 1, not shorter than ⅙ lengths of the respective outer circumferential lengths of the plurality of metal wires 41 are embedded in the electrically insulating member 3 (are in close contact with the inner peripheral surfaces of the indentations 3*a*, respectively, on the electrically insulating member 3). That is, lengths L of the mated portions 41*a* along the circumferential directions of the plurality of metal wires 41 may be not shorter than ⅙ lengths of the respective outer circumferential lengths of the plurality of metal wires 41. Or, in other words, the mated portions 41*a* of the plurality of metal wires 41 may be configured as the portions in the ranges of the central angles of the outer peripheral surfaces of the plurality of metal wires 41 of not smaller than 60 degrees. The lengths L of the portions of the plurality of metal wires 41, by which the plurality of metal wires 41 are embedded in the electrically insulating member 3, are obtained, for example by using an optical microscope or an electron microscope to observe the transverse cross section of the coaxial cable 1 (the cross section perpendicular to the longitudinal direction of the coaxial cable 1).

As will be described in detail later, the shielding layer 4 is formed by heating the core section 6 with the plurality of metal wires 41 wrapped therearound and thereafter passing the heated core section 6 with the plurality of metal wires 41 wrapped therearound through a die to compress the plurality of metal wires 41 to an inner side in the radial directions of the coaxial cable 1. At this point of time, since the plurality of metal wires 41 are scraped against the inner peripheral surface of the die, the outer portions (the opposite portions to the mated portions 41*a*) of the plurality of metal wires 41 in the radial directions of the coaxial cable 1 are formed into substantially flat surface shaped outer portions 41*c*. Note that since the shapes of the outer portions 41*c* of the plurality of metal wires 41 are shaped along the inner peripheral surface of the die, the shapes of the outer portions 41*c* of the plurality of metal wires 41 may not be formed in a completely flat surface shape, but may be formed in a slightly curved surface shape.

In the present embodiment, the plurality of metal wires 41 are embedded in and fixed to the electrically insulating member 3 (that is, the plurality of metal wires 41 are mated to the indentations 3*a*, respectively, on the electrically insulating member 3, and the inner peripheral surfaces of the indentations 3*a* on the electrically insulating member 3 and the respective one parts (the mated portions 41*a*) of the outer peripheral surfaces of the plurality of metal wires 41 are in close contact with each other). Then, in order to maintain the close contact between the electrically insulating member 3 and the plurality of metal wires 41 and ensure the high bendability of the coaxial cable 1, a metal wire made of a material having a low yield strength that is easily plastically deformed may be preferably used for the plurality of metal wires 41. More specifically, a metal wire having a tensile strength of not lower than 200 MPa and not higher than 380 Pa and an elongation of not lower than 7% and not higher than 20% may be used for the plurality of metal wires 41.

In the present embodiment, for the plurality of metal wires 41, a silver-plated annealed copper wire having a plating layer 412 made of a silver on the periphery of a metal wire 411 made of an annealed copper wire is used. Note that the metal wire 411 is not limited to the annealed copper wire, but that a copper alloy wire, an aluminum wire, an aluminum alloy wire, or a wire rod having a low softening temperature with a trace amount of impurities being added to a pure copper or the like can be used as the metal wire 411. Further, the metal for constituting the plating layer 412 is not limited to the silver, but that, for example, a tin or a gold may be used in the plating layer 412, or the plating layer 412 can also be omitted.

Further, the electrical conductivities of the plurality of metal wires 41 may be 98% IACS when an annealed copper wire is used in the plurality of metal wires 41, and may be not lower than 80% IACS when a copper alloy wire is used in the plurality of metal wires 41. In the present embodiment, enhancing the electrical conductivities of the plurality of metal wires 41 is ensured by performing a heat treatment (herein referred to as second heating step) after the compressing step. Details of the producing method for the coaxial cable 1 will be described later.

The sheath 5 is made of, e.g., a fluoropolymer resin such as a PFA or a FEP or the like, a polyvinyl chloride, a crosslinked polyolefin, or the like. For the purpose of making the termination workability high, it is desirable that the sheath 5 is formed in a cylindrical shape by tube extrusion or insert extrusion, and it is desirable that the sheath 5 is formed so as not to be interposed between the plurality of metal wires 41 of the shielding layer 4. In the present embodiment, the sheath 5 made of a fluoropolymer resin is formed by tube extrusion.

The sheath 5 is provided to protect the core section 6 and the shielding layer 4, but in the present embodiment, in addition, the sheath 5 is also serving to tighten the plurality of metal wires 41 from the outer side to the inner side (i.e. inwardly) in the radial directions of the coaxial cable 1, and thereby hold the plurality of metal wires 41 while allowing the plurality of metal wires 41 to remain pressed against the electrically insulating member 3. For that reason, it is desirable that the sheath 5 is provided to tighten the shielding layer 4 constituted by the plurality of metal wires 41 from the outer side to the inner side in the radial directions of the coaxial cable 1.

(Producing Method for the Coaxial Cable 1)

Figure 2:
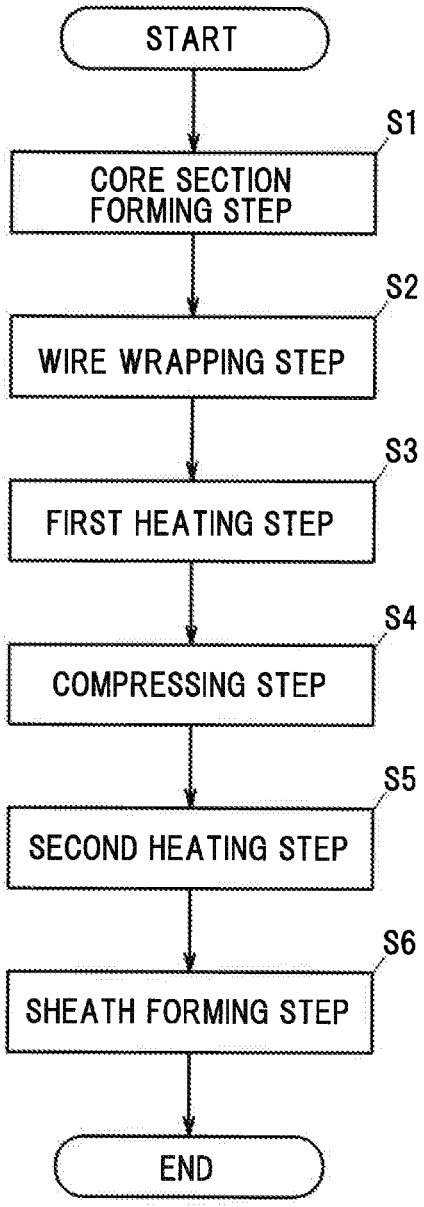
FIG. 2 is a flow chart for producing a coaxial cable.

FIG. 2 is a flow chart for producing the coaxial cable 1. As shown in FIG. 2, in producing the coaxial cable 1, first, in step S1, a core section forming step is carried out. In the core section forming step, the core section 6 is formed by extrusion molding and providing the electrically insulating member 3 over the periphery of the conductor 2 made of a stranded wire conductor. In order to facilitate the peeling off of the electrically insulating member 3 from the conductor 2 during termination working, it is desirable that the electrically insulating member 3 is formed by tube extrusion or insert extrusion.

After that, in step S2, a wire wrapping step is carried out. In the wire wrapping step, the plurality of metal wires 41 are helically wrapped around the periphery of the core section 6. If the plurality of metal wires 41 are wrapped with no gap formation therebetween in the wire wrapping step, even when the plurality of metal wires 41 are pushed to the inner side (i.e. inwardly) in the radial directions of the coaxial cable 1 in the compressing step which will be described later, the plurality of metal wires 41 become resistant to being moved to the inner side in the radial directions of the coaxial cable 1, which may lead to concern that the plurality of metal wires 41 fail to be embedded in the electrically insulating member 3. For that reason, in the wire wrapping step, it is desirable to wrap the plurality of metal wires 41 around the periphery of the core section 6 in such a manner as to allow a gap formation to occur between the plurality of metal wires 41 to a certain extent. Specifically, it is preferable that, in the cross section perpendicular to the axis direction of the coaxial cable 1, the total value of the distances (the lengths of the gaps) between the adjacent ones of the plurality of metal wires 41 in the circumferential direction of the shielding layer 4 is not shorter than 1 time and not longer than 1.5 times the outer diameters of the plurality of metal wires 41.

Figure 3:
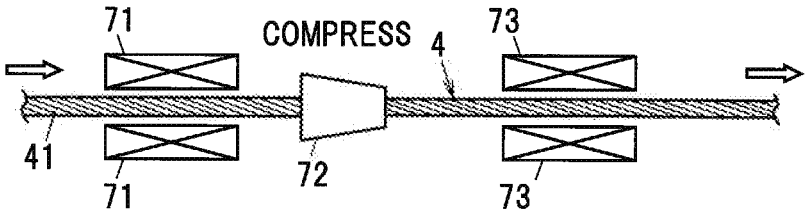
FIG. 3 is an explanatory diagram showing a formation of a shielding layer.

After that, in step S3, a first heating step is carried out. In the first heating step, as shown in FIG. 3, the core section 6 wrapped with the plurality of metal wires 41 therearound is heated by heaters 71. At this point of time, the core section 6 wrapped with the plurality of metal wires 41 therearound is heated to a temperature of not lower than the softening temperature of the electrically insulating member 3 in the core section 6, to thereby soften the electrically insulating member 3 in the core section 6. At this point of time, the core section 6 wrapped with the plurality of metal wires 41 therearound may be heated to such a temperature that no melting of the electrically insulating member 3 in the core section 6 occurs.

After that, in step S4, a compressing step is carried out. In the compressing step, as shown in FIG. 3, the plurality of metal wires 41 and the core section 6 heated in the first heating step are passed through a die 72, to compress the plurality of metal wires 41 to the core section 6 side (to the inner side, i.e. inwardly, in the radial directions of the coaxial cable 1). The hole diameter of the die 72 is formed smaller than the outer diameter of the core section 6 with the plurality of metal wires 41 wrapped therearound when the plurality of metal wires 41 are wrapped around the periphery of the core section 6, so by the core section 6 and the plurality of metal wires 41 being passed through the die 72, the plurality of metal wires 41 are compressed to the inner side (inwardly) in the radial directions of the coaxial cable 1.

Since the electrically insulating member 3 is in the softened state by the first heating step, by the compressing step being carried out, the respective one parts (mated portions 41*a*) in the circumferential directions of the plurality of metal wires 41 are embedded in the electrically insulating member 3. By the plurality of metal wires 41 being embedded in the electrically insulating member 3, the indentations 3*a* are formed on the outer peripheral surface of the electrically insulating member 3, and the respective one parts (mated portions 41*a*) in the circumferential directions of the plurality of metal wires 41 are mated to the indentations 3*a*, respectively, on the electrically insulating member 3. Further, when the indentations 3*a* are formed on the outer peripheral surface of the electrically insulating member 3, the fluidization of the electrically insulating member 3 renders the outer peripheral surface of the electrically insulating member 3 protuberant in the locations between the adjacent ones of the plurality of metal wires 41 in the circumferential direction of the shielding layer 4, to form the protruded portions 3*b* on the outer peripheral surface of the electrically insulating member 3. Since the protruded portions 3*b* are formed in such a manner as to fill the gaps formed between the adjacent ones of the plurality of metal wires 41 in the circumferential direction of the shielding layer 4 and the electrically insulating member 3, the protruded portions 3*b* make a contribution to an improvement in the electrical properties of the coaxial cable 1 in carrying out a high frequency signal transmission.

Also, in the compressing step, by the plurality of metal wires 41 arranged side by side in the circumferential direction of the shielding layer 4 being pushed into the inner side (inwardly) in the radial directions of the coaxial cable 1, the adjacent ones of the plurality of metal wires 41 in the circumferential direction of the shielding layer 4 are pressed and flattened against each other and are brought into surface contact with each other, to form the wire contact portions 41*b* of the plurality of metal wires 41. Further, at this point of time, since the plurality of metal wires 41 are scraped against the inner peripheral surface of the die 72, the outer portions 41*c* each having a substantially flat surface are formed on the plurality of metal wires 41, respectively.

After that, in step S5, a second heating step is carried out. In the second heating step, as shown in FIG. 3, an annealing of the plurality of metal wires 41 is carried out by heating the plurality of metal wires 41 with heaters 73. This allows the strain (residual strain) of the plurality of metal wires 41 resulting from the compressing step to be relieved. Further, since the mitigation of the strain (residual strain) of the plurality of metal wires 41 allows the relaxation of such a force as to cause the plurality of metal wires 41 to return to a straight line shape, and the retention of the shape of the plurality of metal wires 41 remaining wrapped around the periphery of the core section 6, when the sheath 5 is removed in the termination working, the plurality of metal wires 41 become resistant to being unlaid, which makes a contribution to an enhancement in the termination workability. The shielding layer 4 is formed through the above described steps S2 to S5. Note that when no mitigation of the strain (strain due to stress) of the plurality of metal wires 41 is required, step S5 may be omitted.

After that, in step S6, a sheath forming step is carried out. In the sheath forming step, the sheath 5 is provided over the periphery of the shielding layer 4 by extrusion molding. For the purpose of making the termination workability high, it is desirable that the sheath 5 is formed by tube extrusion or insert extrusion. This results in the coaxial cable 1.

(Other Producing Method)

Although in the present embodiment, the plurality of metal wires 41 are embedded in the electrically insulating member 3 in the compressing step, the present invention is not limited thereto, but the electrically insulating member 3 having the indentations 3*a* thereon may preliminarily be formed by extrusion molding or the like, followed by the plurality of metal wires 41 being helically wrapped around the periphery of the electrically insulating member 3 in such a manner as to be mated to the indentations 3*a*, respectively, on the electrically insulating member 3, and subsequently the served shields being compressed in such a manner that the plurality of metal wires 41 are brought into surface contact with each other, to thereby form the shielding layer 4. From the point of view of the ease of the production, it is preferable to employ the production method comprising steps S1 to S6 described above.

(Cable Assembly 10)

Figure 4:
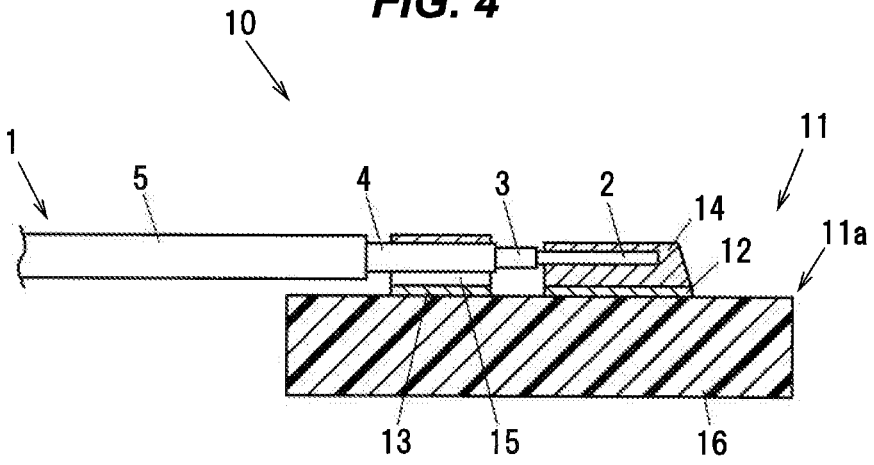
FIG. 4 is a cross-sectional view showing a terminal portion of a cable assembly.

Next, a cable assembly using the coaxial cable 1 will be described. FIG. 4 is a cross-sectional view showing a terminal portion of the cable assembly 10 according to the present embodiment.

As shown in FIG. 4, the cable assembly 10 includes the coaxial cable 1 according to the present embodiment, and a terminal member 11 integrally provided to at least one end portion of the coaxial cable 1.

The terminal member 11 is, e.g., a connector, a sensor, a substrate mounted within the connector or the sensor, or a substrate within an electronic device, or the like. In FIG. 4, a case where the terminal member 11 is a substrate 11*a* is shown. The substrate 11*a* is formed with a signal electrode 12 thereon, to which the conductor 2 of the coaxial cable 1 is connected, and with a ground electrode 13 thereon, to which the shielding layer 4 of the coaxial cable 1 is connected. The substrate 11*a* is made of a printed circuit board in which a conductor pattern including the signal electrode 12 and the ground electrode 13 is printed on a base member 16 made of a resin.

In the terminal portion of the coaxial cable 1, a predetermined length portion of the sheath 5 is removed from the terminal portion of the coaxial cable 1 to expose the underlying shielding layer 4, and further a terminal portion of the exposed shielding layer 4 and a terminal portion of the electrically insulating member 3 are removed to expose the underlying conductor 2. The exposed conductor 2 of the coaxial cable 1 is fixed to the signal electrode 12 of the substrate 11*a* (the terminal member 11) with a connecting material 14 such as a solder or the like, and the exposed conductor 2 of the coaxial cable 1 is electrically connected to the signal electrode 12 of the substrate 11*a* (the terminal member 11). Further, the exposed shielding layer 4 of the coaxial cable 1 is fixed to the ground electrode 13 of the substrate 11*a* (the terminal member 11) with a connecting material 15 such as a solder or the like, and the exposed shielding layer 4 of the coaxial cable 1 is electrically connected to the ground electrode 13 of the substrate 11*a* (the terminal member 11). Note that the connecting materials 14 and 15 such as a solder or the like may not be used in the connection of the exposed conductor 2 to the signal electrode 12 of the substrate 11*a* (the terminal member 11) and the connection of the exposed shielding layer 4 of the coaxial cable 1 to the ground electrode 13 of the substrate 11*a* (the terminal member 11), but that the terminal portion of the cable assembly 10 may be configured in such a manner that, for example, the exposed conductor 2 and the exposed shielding layer 4 of the coaxial cable 1 are fixed to fixing brackets by staking or the like, and thereby are connected to the signal electrode 12 and the ground electrode 13, respectively, of the substrate 11*a* (the terminal member 11). Further, when the terminal member 11 is a connector or a sensor, the terminal portion of the cable assembly 10 may be configured in such a manner that the exposed conductor 2 and the exposed shielding layer 4 of the coaxial cable 1 are connected directly to the electrodes or the elements of the connector or the sensor.

Actions and Advantageous Effects of the Embodiment

As described above, in the coaxial cable 1 according to the present embodiment, the shielding layer 4 is composed of the served shields, while the electrically insulating member 3 includes the indentations 3*a* on the portions of the surface of the electrically insulating member 3 to be brought into contact with the plurality of metal wires 41 respectively, and the indentations 3*a* on the electrically insulating member 3 are configured to be mated to the plurality of metal wires 41 respectively, wherein the shielding layer 4 is configured in such a manner that the portions in the respective circumferential directions of the plurality of metal wires 41 being brought into contact with the electrically insulating member 3 are mated to those indentations 3*a*, respectively, on the electrically insulating member 3, while the adjacent ones of the plurality of metal wires 41 in the circumferential direction of the shielding layer 4 are brought into surface contact with each other.

By the shielding layer 4 being configured in such a manner that the respective one parts (mated portions 41*a*) in the circumferential directions of the plurality of metal wires 41 are mated to the indentations 3*a*, respectively, on the electrically insulating member 3, while the adjacent ones of the plurality of metal wires 41 in the circumferential direction of the shielding layer 4 are brought into surface contact with each other, even when the coaxial cable 1 is repeatedly bent, the coaxial cable 1 becomes resistant to the occurrence of the gap formation between the plurality of metal wires 41. The suppression of the occurrence of the gap formation between the plurality of metal wires 41 makes it possible to enhance the noise property of the coaxial cable 1 and suppress the occurrence of the sucking out. That is, according to the present embodiment, it is possible to achieve the coaxial cable 1 which is designed to be resistant to the occurrence of a degradation in the shielding effect, and to be resistant to the occurrence of a rapid attenuation in a predetermined frequency band.

For example, when the coaxial cable 1 is used in an internal wiring of an electronic device, it is often the case that the coaxial cable 1 is wired in an S shaped or L shaped bent state. In the coaxial cable 1 according to the present embodiment, since the plurality of metal wires 41 are embedded in the electrically insulating member 3, the plurality of metal wires 41 follow the bending of the electrically insulating member 3. That is, in the present embodiment, even when the coaxial cable 1 is bent into an S shape or an L shape, the plurality of metal wires 41 are maintained in the state of being embedded in the electrically insulating member 3, while being maintained in the state of being in surface contact with each other. As a result, even when the coaxial cable 1 is wired by bending, the coaxial cable 1 becomes resistant to the occurrence of the gap formation between the plurality of metal wires 41, and thereby becomes able to suppress the occurrence of a deterioration in the noise property and the electrical properties of the coaxial cable 1.

Also, since the plurality of metal wires 41 are embedded in the electrically insulating member 3, when the sheath 5 is removed in the termination working, the plurality of metal wires 41 become resistant to being unlaid, which therefore makes it possible to enhance the termination workability, and which therefore makes it possible to suppress the occurrence of a disturbance in the shielding layer 4 in the terminal portion of the coaxial cable 1, to enhance the electrical properties of the coaxial cable 1. Furthermore, it is possible to keep the distance between the conductor 2 and the shielding layer 4 constant in the longitudinal direction of the coaxial cable 1, and it is therefore possible to stably keep the impedance of the coaxial cable 1 constant in the longitudinal direction of the coaxial cable 1.

Another Embodiment

Figure 5A:
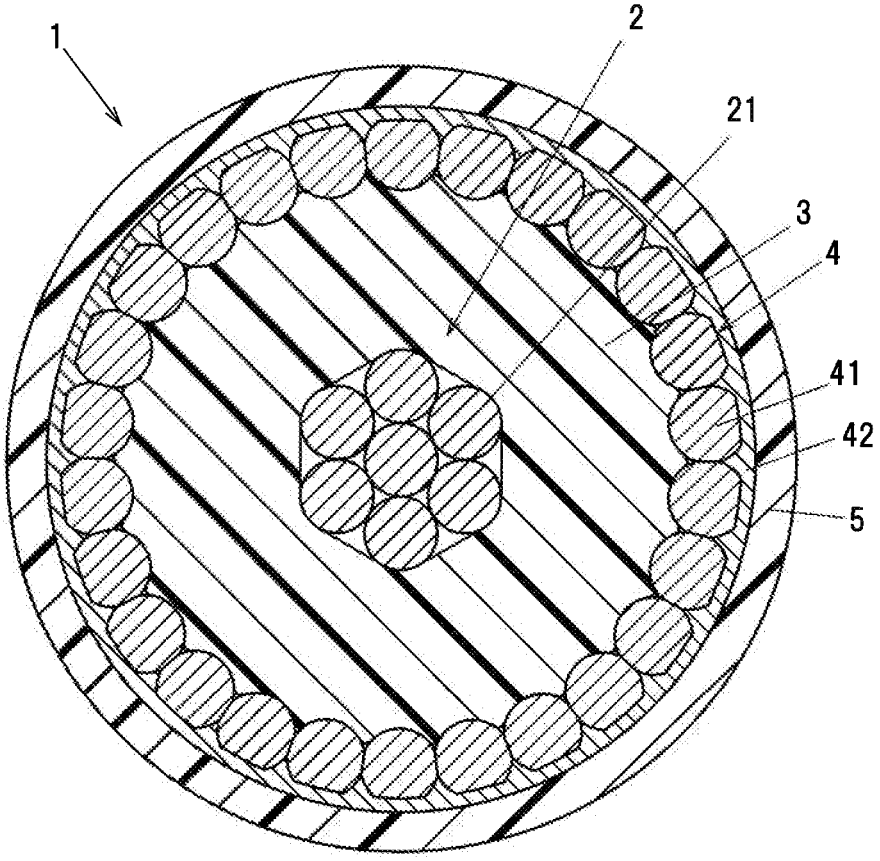
FIG. 5A is a cross-sectional view showing a cross section perpendicular to a longitudinal direction of a coaxial cable according to one embodiment of the present invention.
Figure 5B:
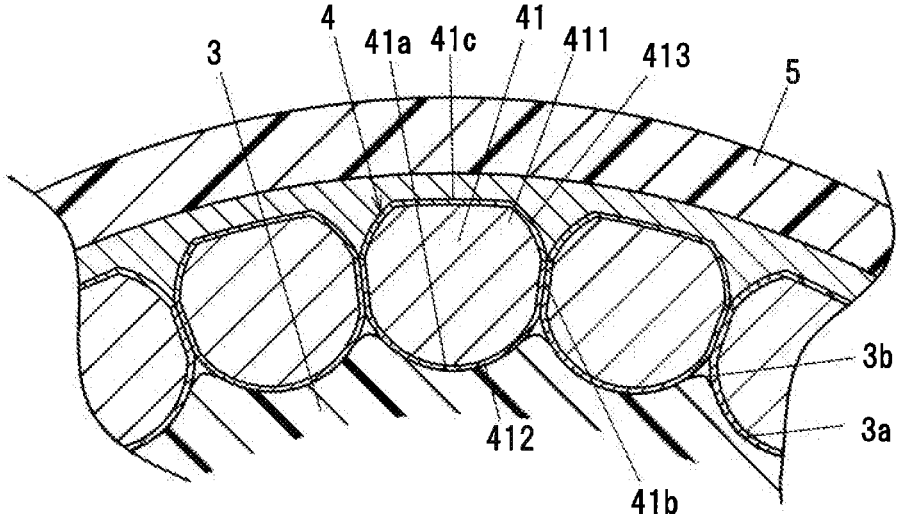
FIG. 5B is an enlarged view of an essential portion of the coaxial cable shown in FIG. 5A.

FIG. 5 is a cross-sectional view showing a cross section perpendicular to the longitudinal direction of a coaxial cable 1 according to another embodiment of the present invention. The coaxial cable 1 shown in FIG. 5 is different from the coaxial cable 1 of FIGS. 1A and 1B only in that it includes a batch plated portion 42.

The batch plated portion 42 is provided to batch coat the entire periphery of the served shields (served shielding portions) together, and the batch plated portion 42, together with the served shields (the plurality of metal wires 41), constitutes the shielding layer 4 which is the outer conductor. The batch plated portion 42 is made of an electrically conductive plating that joins the adjacent ones of the plurality of metal wires 41 side by side. By providing the batch plated portion 42, it is possible to fill the gaps between the adjacent ones of the plurality of metal wires 41 with the batch plated portion 42, and it is possible to thereby further enhance the noise property of the coaxial cable 1. Further, sine the gaps between the plurality of metal wires 41 is eliminated, it is possible to further suppress the occurrence of the sucking out in the band of up to 26 GHz.

In the present embodiment, a plated portion made of a tin is used in the batch plated portion 42. It should be noted, however, that the batch plated portion 42 is not limited thereto, but that, for example, a plated portion made of a silver, a gold, a copper or the like can be used in the batch plated portion 42. It should be noted, however, that, from the point of view of the ease of the production, it is more preferable to use the batch plated portion 42 made of a tin.

By the plurality of metal wires 41 being helically wrapped around the periphery of the electrically insulating member 3 to form the served shields, and being subsequently passed through a bath with a molten tin being held therein, the batch plated portion 42 made of a hot dip plating is formed on the entire periphery of the served shields (the plurality of metal wires 41). At this point of time, in order to facilitate the adhesion of the tin to the entire periphery of the served shields, it is desirable to apply a flux to the entire periphery of the served shields and subsequently pass the flux coated served shields through the bath with the molten tin being held therein. For the flux to be applied to the entire periphery of the served shields, it is possible to use, for example, a rosin-based flux or the like.

Herein, a silver-plated annealed copper wire is used in the plurality of metal wires 41, and the plating layer 412 made of a silver is provided on the surfaces of the plurality of metal wires 41. When the batch plated portion 42 is formed, the silver in a portion of the plating layer 412 being brought into contact with the molten tin being held in the bath is diffused into the molten tin within the bath and, as a result, an intermetallic compound 413 including the copper and the tin is formed between the plurality of metal wires 41 and the batch plated portion 42. As a result of an EDX analysis (an analysis by energy dispersive X-ray spectroscopy) carried out by the present inventors using an SEM (scanning electron microscope), the intermetallic compound 413 composed of the copper and the tin has been able to be identified as having occurred on the surfaces of the plurality of metal wires 41. Note that although the silver constituting the plating layer 412 is considered to be included in the intermetallic compound 413, the silver content in the intermetallic compound 413 is so negligible that it is difficult to detect by the EDX analysis.

The plating layer 412 made of the silver remains on the portions of the plurality of metal wires 41 that are not brought into contact with the batch plated portion 42 (the portions of the plurality of metal wires 41 that are not brought into contact with the molten tin being held in the bath during the plating). That is, the plating layer 412 made of the silver remains on the mated portions 41*a*, the wire contact portions 41*b*, and the portions between the mated portions 41*a* and the wire contact portions 41*b*. In a high frequency signal transmission, the electric current is concentrated in the electrically insulating member 3-side of the shielding layer 4. Because of the presence of the plating layer 412 made of the silver, it is possible to suppress the occurrence of a lowering in the electrical conductivity of the shielding layer 4, and thereby maintain a good attenuation property of the coaxial cable 1.

(Application to a Multi-Core Cable)

Figure 6:
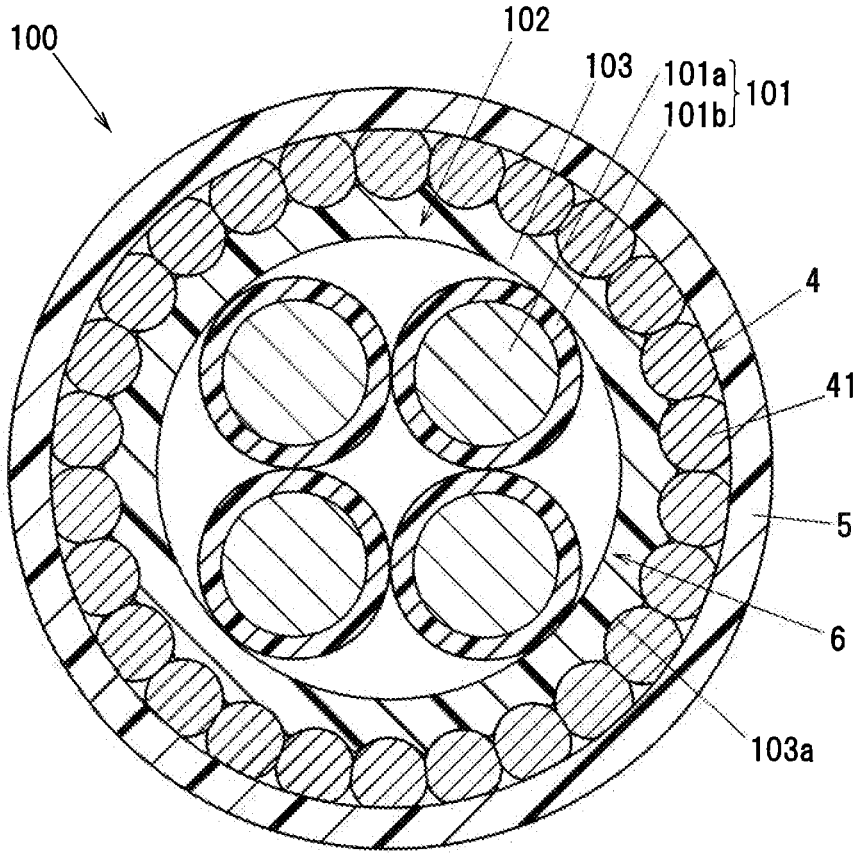
FIG. 6 is a cross-sectional view showing a cross section perpendicular to a longitudinal direction of a multi-core cable to which the present invention is applied.

Further, the present invention can also be applied to a multi-core cable. The multi-core cable 100 shown in FIG. 6 is similar to the coaxial cable 1 shown in FIG. 1 in which a cable core 102 is provided in place of the conductor 2 and the electrically insulating member 3. The cable core 102 includes a plurality (herein, four) of electrical insulated wires 101, each of which includes a conductor 101*a* and an electrically insulating member 101*b* provided over a periphery of the conductor 101*a*, and an inner sheath 103 provided over a periphery of the plurality (herein, four) of electrical insulated wires 101 being stranded together. The inner sheath 103 includes indentations 103*a* on portions of a surface of the inner sheath 103 to be brought into contact with the plurality of metal wires 41 respectively, and the indentations 103*a* on the inner sheath 103 are configured to be mated to the plurality of metal wires 41 respectively, wherein the shielding layer 4 is configured in such a manner that the portions in the respective circumferential directions of the plurality of metal wires 41 being brought into contact with the inner sheath 103 are mated to those indentations 103*a*, respectively, on the inner sheath 103, while the adjacent ones of the plurality of metal wires 41 in the circumferential direction of the shielding layer 4 are brought into surface contact with each other. The inner sheath 103 may be formed, for example, by tube extrusion. As a result, during the termination working, performing the removal of the inner sheath 103 to expose the underlying electrical insulated wires 101 is facilitated, and the operating efficiency for the termination working can therefore be enhanced, as compared with the case where the inner sheath 103 is formed by full extrusion. Note that, as with the coaxial cable 1 shown in FIGS. 5A and 5B, the multi-core cable 100 may be configured in such a manner that the shielding layer 4 has the structure including a batch plated portion that batch coats the entire periphery of the served shields together composed of the plurality of metal wires 41.

Further, it is also possible to configure the multi-core cable 100 by bundling a plurality of the coaxial cables 1 shown in FIG. 1 together and providing a jacket in such a manner as to batch coat the periphery of the plurality of the coaxial cables 1 together. Furthermore, it is also possible to configure the multi-core cable 100 by bundling the coaxial cable 1 shown in FIG. 1 and other electric wires together, and providing a jacket in such a manner as to batch coat the periphery of the coaxial cable 1 shown in FIG. 1 and the other electric wires together.

SUMMARY OF THE EMBODIMENT

Next, the technical ideas grasped from the above described embodiments will be described with the aid of the reference characters and the like in the embodiments. It should be noted, however, that each of the reference characters and the like in the following descriptions is not to be construed as limiting the constituent elements in the appended claims to the members and the like specifically shown in the embodiments.

[1] A coaxial cable (1), comprising: a conductor (2); an electrically insulating member (3) provided over a periphery of the conductor (2); a shielding layer (4) composed of served shields including a plurality of metal wires (41) helically wrapped around a periphery of the electrically insulating member (3) to be provided over a periphery of the electrically insulating member (3); and a sheath (5) provided over a periphery of the shielding layer (4), wherein the electrically insulating member (3) includes indentations (3*a*) on portions of a surface of the electrically insulating member (3) to be brought into contact with the plurality of metal wires (41) respectively, wherein the indentations (3*a*) on the electrically insulating member (3) are mated to the plurality of metal wires (41) respectively, wherein the shielding layer (4) is configured in such a manner that portions in respective circumferential directions of the plurality of metal wires (41) being brought into contact with the electrically insulating member (3) are mated to the indentations (3*a*), respectively, on the electrically insulating member (3), and adjacent ones of the plurality of metal wires (41) in a circumferential direction of the shielding layer (4) are brought into surface contact with each other.

[2] The coaxial cable (1) as defined in the above [1], wherein, at a cross section perpendicular to a longitudinal direction of the coaxial cable (1), not shorter than ⅙ lengths of outer circumferential lengths of the plurality of metal wires (41) are mated to the indentations (3*a*), respectively, on the electrically insulating member (3).

[3] The coaxial cable (1) as defined in the above [1] or [2], wherein the plurality of metal wires (41) comprise a tensile strength of not lower than 200 MPa and not higher than 380 Pa, and an elongation of not lower than 7% and not higher than 20%.

[4] A method for producing a coaxial cable (1) configured to include a conductor (2), an electrically insulating member (3) provided over a periphery of the conductor (2), a shielding layer (4) composed of served shields including a plurality of metal wires (41) helically wrapped around a periphery of the electrically insulating member (3) to be provided over the periphery of the electrically insulating member (3), and a sheath (5) provided over a periphery of the shielding layer (4), the method comprising: providing the electrically insulating member (3) over the periphery of the conductor (2) by extrusion molding to form a core section (6); helically wrapping the plurality of metal wires (41) around a periphery of the core section (6); heating the core section (6) wrapped with the plurality of metal wires (41) therearound to soften the electrically insulating member (3) of the core section (6); passing the plurality of heated metal wires (41) and the heated core section (6) through a die (72) to compress the heated metal wires (41) toward the core section (6), thereby forming indentations (3*a*) to be mated to the plurality of metal wires (41) respectively, on portions of a surface of the softened electrically insulating member (3) of the core section (6) to be brought into contact with the plurality of metal wires (41) respectively, mating portions in respective circumferential directions of the plurality of metal wires (41) to be brought into contact with the electrically insulating member (3) to the indentations (3*a*), respectively, on the electrically insulating member (3), and bringing adjacent ones of the plurality of metal wires (41) in a circumferential direction of the shielding layer (4) into surface contact with each other, to thereby form the shielding layer (4); heating the shielding layer (4), to thereby relieve a strain in the plurality of metal wires (41) resulting from the compressing; and providing the sheath (5) by extrusion molding over the periphery of the shielding layer (4).

[5] A cable assembly (10), comprising: the coaxial cable (1) as defined in any one of the above [1] to [3]; and a terminal member (11) integrally provided to at least one end portion of the coaxial cable (1).

Although the embodiments of the present invention have been described above, the above described embodiments are not to be construed as limiting the inventions according to the appended claims. Further, it should be noted that not all the combinations of the features described in the embodiments are indispensable to the means for solving the problem of the invention. Further, the present invention can be appropriately modified and implemented without departing from the spirit thereof.

Although the embodiments of the present invention have been described above, the above described embodiments are not to be construed as limiting the inventions according to the appended claims. Further, it should be noted the not all the combinations of the features described in the embodiments are indispensable to the means for solving the problem of the invention. Further, the present invention can be appropriately modified and implemented without departing from the spirit thereof.

What is claimed is:

1. A coaxial cable, comprising:

a conductor;

an electrically insulating member provided over a periphery of the conductor; a shielding layer composed of served shields including a plurality of metal wires helically wrapped around a periphery of the electrically insulating member to be provided over a periphery of the electrically insulating member; and a sheath provided over a periphery of the shielding layer, wherein the electrically insulating member includes indentations on portions of a surface of the electrically insulating member to be brought into contact with the plurality of metal wires respectively, wherein the indentations on the electrically insulating member are mated to the plurality of metal wires respectively, wherein the shielding layer is configured in such a manner that first circumferential portions of the plurality of metal wires being brought into contact with the electrically insulating member are mated to the indentations, respectively, on the electrically insulating member, second circumferential portions of the plurality of metal wires are provided radially outwardly with respect to the first circumferential portions, and adjacent ones of the plurality of metal wires in a circumferential direction of the shielding layer are brought into surface contact with each other, wherein each of the first circumferential portions has an arc shape while each of the second circumferential portions has a flat shape, and wherein, at a cross section perpendicular to a longitudinal direction of the coaxial cable, not shorter than ⅙ lengths of outer circumferential lengths of the plurality of metal wires are mated to the indentations, respectively, on the electrically insulating member, wherein the plurality of metal wires include wire contact portions, and wherein the plurality of metal wires are in contact with each other, wherein the electrically insulating member includes at least one protruded portion formed on an outer peripheral surface of the electrically insulating member, and wherein a gap is provided between the at least one protruded portion of the electrically insulating member and the wire contact portions of the plurality of metal wires.

2. The coaxial cable according to claim 1, wherein the plurality of metal wires comprise a tensile strength of not lower than 200 MPa and not higher than 380 Pa, and an elongation of not lower than 7% and not higher than 20%.

3. The coaxial cable according to claim 2, wherein the electrically insulating member includes a plurality of protruded portions formed on an outer peripheral surface of the electrically insulating member conforming to a shape of the metal wires.

4. A method for producing the coaxial cable according to claim 1, configured to include a conductor, an electrically insulating member provided over a periphery of the conductor, a shielding layer composed of served shields including a plurality of metal wires helically wrapped around a periphery of the electrically insulating member to be provided over the periphery of the electrically insulating member, and a sheath provided over a periphery of the shielding layer, the method comprising:

providing the electrically insulating member over the periphery of the conductor by extrusion molding to form a core section;

helically wrapping the plurality of metal wires around a periphery of the core section;

heating the core section wrapped with the plurality of metal wires therearound to soften the electrically insulating member of the core section;

passing the plurality of heated metal wires and the heated core section through a die to compress the heated metal wires toward the core section, thereby forming indentations to be mated to the plurality of metal wires respectively, on portions of a surface of the softened electrically insulating member of the core section to be brought into contact with the plurality of metal wires respectively, mating portions in respective circumferential directions of the plurality of metal wires to be brought into contact with the electrically insulating member to the indentations, respectively, on the electrically insulating member, and bringing adjacent ones of the plurality of metal wires in a circumferential direction of the shielding layer into surface contact with each other, to thereby form the shielding layer;

heating the shielding layer, to thereby relieve a strain in the plurality of metal wires resulting from the compressing; and providing the sheath by extrusion molding over the periphery of the shielding layer.

5. A cable assembly, comprising:

the coaxial cable according to claim 1; and a terminal member integrally provided to at least one end portion of the coaxial cable.

6. The coaxial cable according to claim 1, further comprising:

a batch plated portion provided between the shielding layer and the sheath, wherein the second circumferential portions of the plurality of metal wires are brought into contact with the batch plated portion.

7. The coaxial cable according to claim 1, wherein the electrically insulating member includes a protruded portion conforming to a shape of the metal wires.

8. The coaxial cable according to claim 1, wherein the electrically insulating member includes a plurality of protruded portions formed on an outer peripheral surface of the electrically insulating member.

9. The coaxial cable according to claim 1, wherein the electrically insulating member includes a plurality of protruded portions formed on an outer peripheral surface of the electrically insulating member conforming to a shape of the metal wires.

10. The coaxial cable according to claim 1, wherein the plurality of metal wires are in contact with the adjacent ones of the plurality of metal wires at the wire contact portions absent a gap therebetween.

11. A coaxial cable, comprising:

a conductor;

an electrically insulating member provided over a periphery of the conductor; a shielding layer including served shields including a plurality of metal wires wrapped around a periphery of the electrically insulating member to be provided over a periphery of the electrically insulating member; and a sheath provided over a periphery of the shielding layer, wherein the electrically insulating member includes indentations on portions of a surface of the electrically insulating member to be brought into contact with the plurality of metal wires respectively;

wherein the indentations on the electrically insulating member are mated to the plurality of metal wires respectively, wherein the shielding layer is configured in such a manner that first circumferential portions of the plurality of metal wires being brought into contact with the electrically insulating member are mated to the indentations, respectively, on the electrically insulating member, second circumferential portions of the plurality of metal wires are provided radially outwardly with respect to the first circumferential portions, and adjacent ones of the plurality of metal wires in a circumferential direction of the shielding layer are brought into surface contact with each other, and wherein each of the second circumferential portions includes a flat shape wherein the plurality of metal wires include wire contact portions, and wherein the plurality of metal wires are in contact with each other, wherein the electrically insulating member includes at least one protruded portion formed on an outer peripheral surface of the electrically insulating member, and wherein a gap is provided between the at least one protruded portion of the electrically insulating member and the wire contact portions of the plurality of metal wires.

12. The coaxial cable according to claim 11, wherein each of the first circumferential portions includes an arc shape.

13. The coaxial cable according to claim 11, further comprising:

a batch plated portion provided between the shielding layer and the sheath, wherein the second circumferential portions of the plurality of metal wires are brought into contact with the batch plated portion.

14. The coaxial cable according to claim 11, wherein, at a cross section perpendicular to a longitudinal direction of the coaxial cable, not shorter than ⅙ lengths of outer circumferential lengths of the plurality of metal wires are mated to the indentations, respectively, on the electrically insulating member.

15. The coaxial cable according to claim 11, wherein the plurality of metal wires are in contact with the adjacent ones of the plurality of metal wires at the wire contact portions absent a gap therebetween.

* * * * *